US011021883B2

(12) United States Patent
Izquierdo Jaen

(10) Patent No.: US 11,021,883 B2
(45) Date of Patent: Jun. 1, 2021

(54) CARRIABLE AND MODULAR CABIN

(71) Applicant: Alejandro Izquierdo Jaen, Barcelona (ES)

(72) Inventor: Alejandro Izquierdo Jaen, Barcelona (ES)

( * ) Notice: Subject to any disclaimer, the term of this patent is extended or adjusted under 35 U.S.C. 154(b) by 0 days.

(21) Appl. No.: 16/652,721

(22) PCT Filed: Jun. 12, 2018

(86) PCT No.: PCT/ES2018/070423
§ 371 (c)(1),
(2) Date: Apr. 1, 2020

(87) PCT Pub. No.: WO2019/068942
PCT Pub. Date: Apr. 11, 2019

(65) Prior Publication Data

US 2020/0240158 A1 Jul. 30, 2020

(30) Foreign Application Priority Data

Oct. 5, 2017 (ES) ..... 201731171U

(51) Int. Cl.
*E04H 1/00* (2006.01)
*E04B 1/343* (2006.01)
(Continued)

(52) U.S. Cl.
CPC ..... *E04H 1/005* (2013.01); *E04B 1/34336* (2013.01); *E04B 1/34869* (2013.01); *E04H 2001/1283* (2013.01)

(58) Field of Classification Search
None
See application file for complete search history.

(56) References Cited

U.S. PATENT DOCUMENTS 5,285,604 A * 2/1994 Carlin ..... B60P 3/14 52/143
6,179,522 B1 * 1/2001 Sanford ..... B09B 3/00 405/129.55

(Continued)

FOREIGN PATENT DOCUMENTS

WO 212123118 A1 9/2012
WO 213004985 A1 1/2013

OTHER PUBLICATIONS

Int'l. Search Report for PCT/ES2018/070423, dated Oct. 18, 2018.

*Primary Examiner* — Joshua K Ihezie
(74) *Attorney, Agent, or Firm* — Blue Filament Law PLLC

(57) ABSTRACT

A carriable and modular cabin is provided with a parallel-epipedal body creating a diaphanous space. Right bulkhead and left bulkhead separate the body from respective right and left side compartments. Other cabins can be stacked through the use of anchorages. Two tanks of water are provided including a tank of clean water possessing a submerged pump and a water entrance and a water exit. The second tank of waste water also possesses a submerged pump. The washbasin WC and shower, are located on the inner wall of the body. In the said bulkhead the clean water comes through a duct and is channeled towards the sanitary elements. The bulkhead includes an air conditioning compressor, water heater, and an inverter connected to one or more solar panels. The covers are provided with ventilation grids.

18 Claims, 3 Drawing Sheets

(51) Int. Cl.
*E04B 1/348* (2006.01)
*E04H 1/12* (2006.01)

(56) References Cited

U.S. PATENT DOCUMENTS

| | | | | |
|---|---|---|---|---|
| 10,549,675 | B2 * | 2/2020 | Devine | H02S 20/30 |
| 2002/0189173 | A1 * | 12/2002 | Staschik | C02F 9/00 52/79.1 |
| 2003/0009954 | A1 * | 1/2003 | Bradley | E04H 1/1205 52/79.1 |
| 2005/0225116 | A1 * | 10/2005 | Fisher | B60P 3/341 296/168 |
| 2005/0284035 | A1 * | 12/2005 | DeOvando | E04B 1/3431 52/79.1 |
| 2013/0086849 | A1 | 4/2013 | Clouser et al. | |
| 2013/0291450 | A1 * | 11/2013 | Hillje | E04H 9/14 52/79.8 |
| 2014/0116870 | A1 * | 5/2014 | Kamen | E04H 1/1222 202/83 |
| 2015/0034634 | A1 * | 2/2015 | Mullaney | B65D 90/06 220/1.5 |
| 2016/0333569 | A1 | 11/2016 | Johnston | |
| 2016/0369689 | A1 * | 12/2016 | Brewer | H02J 9/066 |
| 2017/0025988 | A1 * | 1/2017 | Blaskovich | H02S 20/23 |
| 2018/0361906 | A1 * | 12/2018 | Devine | E04H 1/02 |
| 2020/0131756 | A1 * | 4/2020 | Devine | E03B 1/041 |

* cited by examiner

CARRIABLE AND MODULAR CABIN

OBJECT OF THE INVENTION

The invention, as stated in the title of this specification and disclosed in detail hereinbelow, refers to a carriable and modular cabin that provides novel advantages and has novel characteristics relative to the current state-of-the-art.

The object of this invention includes a small size and carriable compact cabin the configuration of which contemplates the incorporation of facilities allowing its habitability illustratively including energy, water supply, and storage of clean and waste water, to allow its autonomous operation such facilities being located in modules couplable to the cabin thereby allowing them to be easily replaced.

FIELD OF APPLICATION OF THE INVENTION

The field of application of this invention is within the sector of construction, and in particular scope within the industry engaged in producing carriable habitable elements.

BACKGROUND OF THE INVENTION

With reference to the current state-of-the-art, it shall be pointed out that at least the applicant is not aware of the existence of any other carriable and modular cabin, or of any other similar invention possessing technical, structural, nor constitutive characteristics equal or similar to those presented by the one herein claimed.

EXPLANATION OF THE INVENTION

The carriable and modular cabin of the instant invention provides novel advantages and has novel characteristics within its field of application relative to the current state-of-the-art, the details thereof appearing in the final claims attached to this description.

The inventive compact small size carriable cabin includes all the facilities necessary for habitability in an independent manner, illustratively including energy, water supply, and storage of clean and waste water, the facilities located in modules that are couplable and uncouplable to the structure of the cabin in compartments defined by both bulkheads, allowing the modules to be easily replaced.

Thus, the essential objective of the invention is to provide a carriable and mobile space, that preferably is also stackable, with every comfort and utility of a room, for example a small hotel room, that is also fully independent as to electric energy, water supply, pipes and works.

This allows an individual having a land lot the opportunity to rent out the inventive cabin for short stays. It is appreciated that the inventive cabin can also be used for purposes other than as a sleeping quarters. In some inventive embodiments, the internal space of the cabin does not include beds. It is appreciated that a variety of designs and uses for the internal space of the inventive cabin are contemplated herein.

In addition, the construction of the inventive carriable and modular cabin allows the fitting of two or more cabins at several heights, each being independent from the others, such that the operation of one does not affect the other.

The following are illustrative examples of the different applications and advantages of embodiments of the inventive cabin:

For a guesthouse. Using a land lot, several cabins can be arranged to offer stays to the guests, with the advantage that it would be not necessary to install any supply network. This embodiment allows for the use of only front desk staff and cleaning staff for cleaning the cabins and for filling and emptying the module tanks. It is appreciated that the cabins can be placed in any wooded, deserted, mountainous, snowy, etc. setting without interfering with their environment and are therefore environment-friendly because they do not generate any type of waste outwardly nor require building works on the land.

For camping. Installed on camping plots as an intermediate option between a bungalow and a tent but with every luxury of a hotel room. Owing to their small size, several units could be placed on a same plot.

For airports. Placed within the space owned by an airport, either in open air or within its premises, to be used by individuals spending a long length layover or whose flight has been delayed. This prevents the need to leave the airport to seek a hotel and allows individuals to avoid having to spend time queueing for visas and administrative controls in order to leave and the reenter the airport.

As a mountain or desert areas shelter. Installing bunks within the inventive cabin and a first aid kit, in addition to a small food stock, it can offer shelter for people in high mountain areas or in any other geologic area.

At highway rest areas. Installing embodiments of the inventive cabin at highway rest areas affords a more comfortable overnight stay relative to spending the night in a vehicle or truck. In this case, it would be an ideal solution, because no building work would be necessary to offer the service.

In advertising campaigns. Installed at street level to offer promotion, marketing and advertising services or for any other activity in which a space is required as the one offered.

As student residences. Used as a dormitory for students who require a place to to study and sleep close to their faculties, provided that it is born in mind that the modules have no kitchen available.

As guardhouses. Removing the beds and installing the necessary equipment, embodiments of the inventive cabin offer a secure solution for locations in progress areas, housing developments, industrial areas, etc. where security personnel is required or where a control center is required.

As dressing rooms. For events, such as concerts, festivals, etc., embodiments of the inventive cabin provide an ideal private dressing room space.

As external guest room. As an additional room in houses having a land lot or space on their estate, or to provide lodging outside the main building.

It is appreciated that the cabin can be moved in ordinary carriage thanks to its small size, to any location wished without requiring building work, installing pipes or water supply or electric network. It is appreciated that in some embodiments the inventive cabin is a rectangular space of around **22*m*2** to which different uses can be given as disclosed herein.

With the cabin of the invention it is not necessary to have secondary annexes for sanitary elements or showers, because the compartments determined by the two bulkheads that divide the cabin in their respective side ends, are used, one of them, to place systems of electrical supply and the other for water entrance and exit pipes from and towards the tanks it possesses, as well as to place an air-conditioning compressor and, optionally, storage batteries.

Optionally, the cabin can also be connected to a utilities network, therefore cutting down the cost of the module.

Within the base of the floor of the cabin, two tanks are contemplated to be placed:

A drinkable water tank, with a submerged pump to supply the systems of shower, WC and washbasin water. This tank possesses a water entrance through the related side compartment of the cabin and an exit, in the same side compartment, but below, close to a pump for emptying it. A slight tilt angle facilitates loading the pump and emptying the tank.

And a waste water tank, of the WC, shower and washbasin. This tank, same as the preceding, has an entrance through the side compartment of the cabin, to facilitate pressure cleaning and an exit in the same side in the lower part, connected to a small extraction pump built in the tank itself for emptying it. It is appreciated that the extraction pump avoids the need for tubes of suction pumps within the tank to prevent fecal waste from leaking at the moment of withdrawing the sucking tubes, creating thus a more hygienic environment.

With all this, what essentially distinguishes the carriable cabin of the invention is the fact that the body of the inventive cabin has a parallelepipedal rectangular configuration forming it, creating a diaphanous space in which different distributions can be made, and possesses at its two side ends bulkheads that separate it of respective compartments, providing support, together with the floor and the ceiling of the body, to the main auxiliary elements necessary for the operation of the inventive cabin such as those necessary to supply sanitary water, that are installed on the floor and one of the bulkheads, and those necessary for the supply of energy, such as electric energy, that are installed between the ceiling and the other of the bulkheads, being protected in both sides with openable covers, that define the external limit of the compartments and give access to the supply auxiliary elements, allowing maintenance tasks and/or the replacement thereof as modular elements, which facilitates to a large extent the aforementioned maintenance tasks.

The disclosed carriable and modular cabin consists, therefore, as an innovative structure having characteristics unknown up to now for the purpose to which it is designed, reasons that together with its practical utility, provide it with sufficient ground to obtain the privilege of exclusivity applied for.

DESCRIPTION OF THE DRAWINGS

To complement the description of the invention and in order to assist in understanding the characteristics of the invention, attached to this specification, as an integral part thereof, are drawings for illustration that do not limit the purpose of the invention and are described as follows:

The FIG. 1.—It shows a schematic view in perspective and exploded views an example of an embodiment of the carriable and modular cabin, its general configuration and the main parts comprised.

Figure 1:
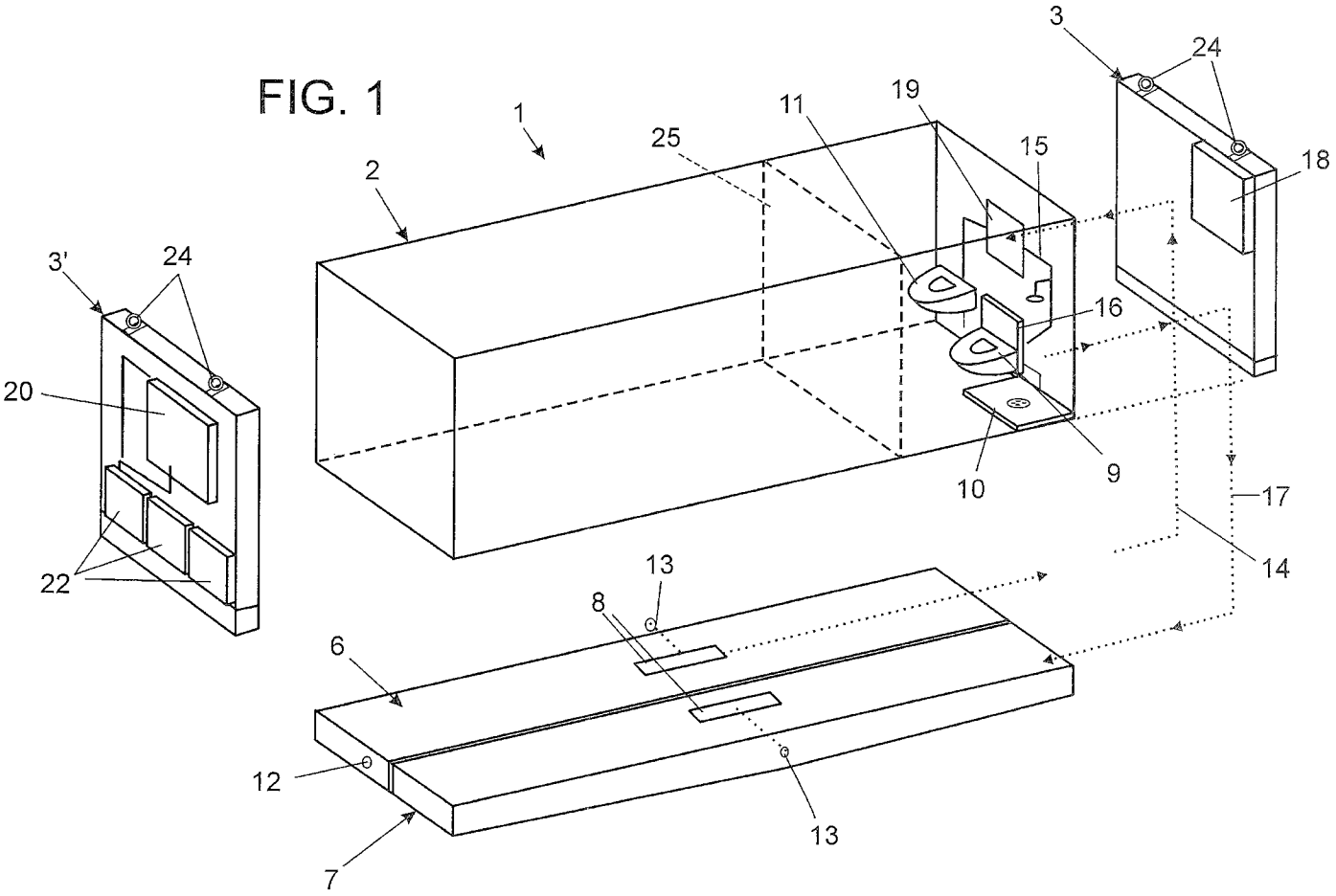
Figure 2:
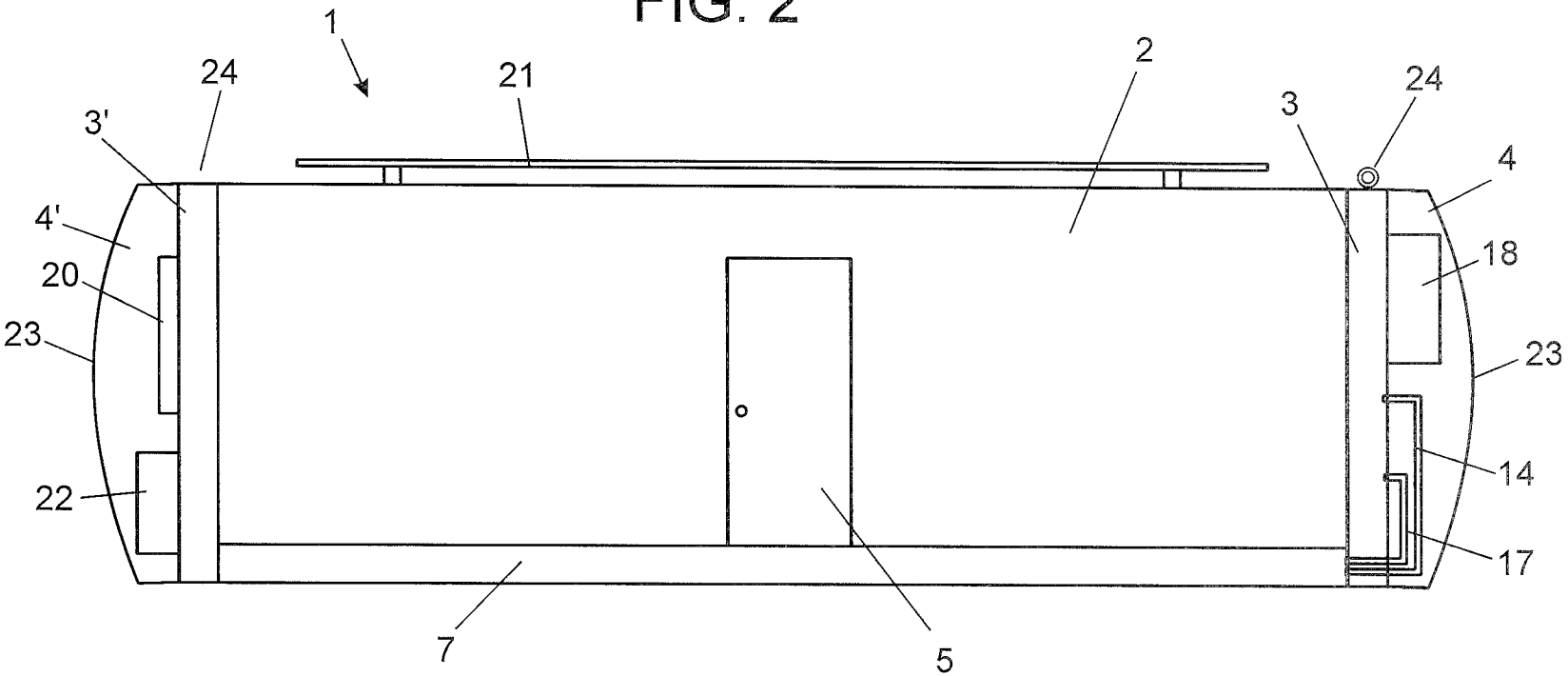
Figure 3:
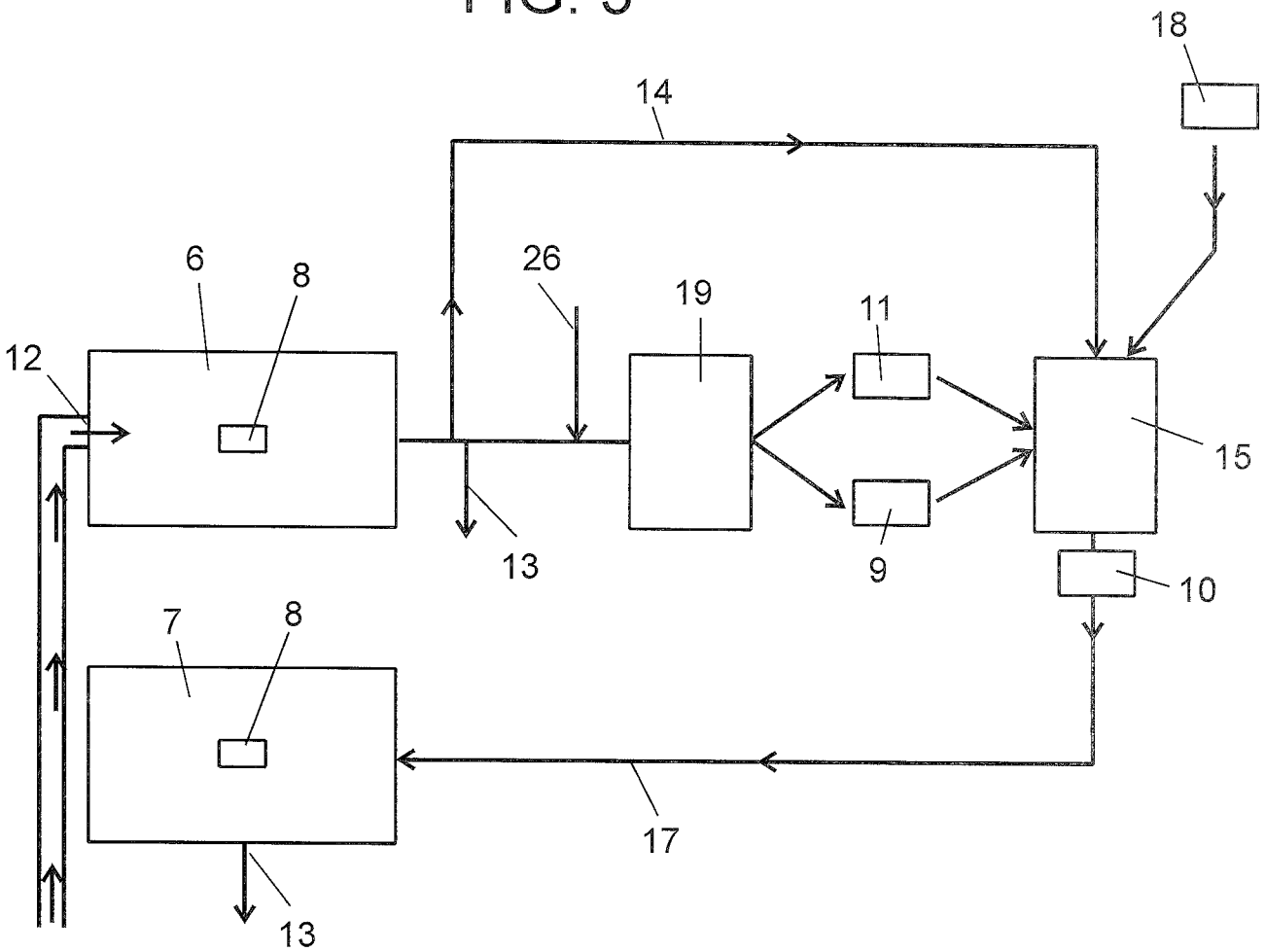

The FIG. 2.—It shows an elevation view of the carriable and modular cabin according to embodiments of the invention; and The FIG. 3.—It shows a diagram representative of the water circuit comprised in the cabin according to embodiments of the invention.

PREFERRED EMBODIMENT OF THE INVENTION

As shown in the figures, a non-limitative example of the carriable and modular cabin is depicted that comprises the parts and elements that are stated and disclosed in detail below, according to the numerals adopted, with the list of numeral references below for each element:

1. cabin
2. parallelepipedal body
3. right bulkhead, 3' left bulkhead
4. right compartment, 4' left compartment
5. doors, windows, glazing
6. clean water tank
7. waste water tank
8. submerged pump
9. WC
10. shower
11. washbasin
12. water entrance
13. water exit
14. entrance distribution duct
15. circuit of sanitary water exploitation
16. backpack cistern
17. exit distribution duct
18. air-conditioning compressor
19. water heater
20. inverter
21. solar panels
22. storage batteries
23. side covers
24. anchorages
25. partition
26. connection to the water supply network Thus, as it can be seen in the figures, the cabin (1) is configured out of a body (2) having a rectangular parallelepipedal configuration, made of composite or other suitable thermally insulating material, creating a diaphanous space in which different distributions can be carried out, depending on the application of use in each case, at the side ends of which both right bulkhead (3) and left bulkhead (3') have been provided that separate them from respective side compartments right (4) and left (4'), providing support, together with the floor and ceiling of the body (2), to the main auxiliary elements necessary for the operation of the cabin (1), concretely, at least, one bulkhead illustratively the right bulkhead (3) provides support to auxiliary elements of sanitary water supply, and the other builkhead, illustratively the left bulkhead (3') provides support to auxiliary elements of electric energy supply, the bulkheads (3, 3') being arranged behind respective openable covers (23), that define the external limit of the compartment (4, 4'), and give access to them allowing maintenance tasks and/or their replacement as modular elements.

The said bulkheads (3,3') are made of a very strong material, as they are supporting the weight of the structure of the cabin and, eventually, the weight of the other cabins (1) that can be stacked on it.

Embodiments of the inventive cabin (1) have different designs, as for the different doors, windows or glazing (5), such as transparent ceilings, for example in the case that they are designed for tourism in wooded areas or having appealing views.

In addition, under the floor of the rectangular body (2) of the cabin (1), two water tanks are provided, one of clean water (6) and another of waste water (7) that virtually occupy the full extent of the floor and communicate with the right side compartment (4) in which the auxiliary elements of sanitary water supply are built-in.

Concretely, the tank of clean water (6) possesses a submerged pump (8) to supply the systems of shower (10), WC (9) and washbasin (11). This tank (6) possesses a water entrance (12) through one of the sides of the cabin (1), to allow its filling, and a water exit (13) for its emptying, located close to the said submerged pump (8), both arranged with a slight tilt angle that facilitates emptying the tank and loading the pump.

It is appreciated that the tank of waste water (7), arranged in parallel to the tank of clean water (6) under the body (2) of the cabin (1), is designed to receive all the water coming from the unloading cistern of the shower (10), where the waste water comes with the rest of sanitary elements such as, WC (9) and washbasin (11), for its further storage until the moment of emptying it, for which it possesses another submerged pump (8) with connection to a water exit (13) outwardly, to proceed to pouring it in a vessel of a tank vehicle, without the use of external pumps.

It shall be pointed out that, to cut costs down, the submerged pump (8) of this tank of waste water (7) is optional, and emptying the tank (7) can be carried out with the same system that is used in the portable WCs, by means of a sucking system.

In inventive embodiments, both tanks (6 and 7), in their interior possesses a slight unevenness converging towards their center, to facilitate that the fluids fall by gravity down to the respective submerged pumps (8), placed at the center. With this, in addition, the gravity center of the cabin (1) is kept as much centered as possible.

In the preferred embodiment, the right bulkhead (3) that separates the compartment of that same side (4), serves as support to the systems and elements of sanitary water supply, and the sanitary elements to which it is led, such as the WC (9) shower (10) and washbasin (11), being in the inner wall of the body (2) attached to the bulkhead (3), normally separated from the rest by means of some partition (25).

Concretely in the bulkhead (3), the clean water arrives, from the tank of clean water (6), through a distribution duct entrance (14) and it is channeled towards the sanitary elements, preferably with a circuit of exploitation of sanitary water (15) (device available in the market) that connects WC (9) shower (10) and washbasin (11).

It is sought to exploit the shower (10) and washbasin (11) waste water by channeling it up to a system of WC (9) with a backpack cistern (16) independent from a built-in crushing pump, that is explained hereafter, and that serves to store the water exiting from the shower and the washbasin for its use when flushing the loo.

This way, the water of the shower and the washbasin is recycled to push the waste of the WC.

This backpack cistern (16) generates, by itself, the pressure necessary to push the waste towards a crushing device that sends it to be crushed through the related exit distribution duct (17) toward the tank of waste water (7) with which it is connected, located under the floor of the body (2) of the cabin (1).

Preferably, the cistern (16) is supplied by four sources to keep its level: shower (10), washbasin (11) tank of clean water (6) and, optionally from the condensation water of an air-conditioning compressor (18) with which, optionally, the cabin (1) is also provided in the right bulkhead (3) of the right compartment (4).

In inventive embodiments lacking the circuit of exploitation of sanitary water (15), the cabin (1) will possess, in the right compartment (4) of water supply, a common WC cistern, coupling to the exit of the drain of the WC (9) and a crushing pump that pushes the waste up to the tank of waste water (7).

In other inventive embodiments the cabin also contemplates, preferably, the incorporation of a water heater (19) installed within the central body (2) thereof, close to the sanitary elements, to provide hot water service to the washbasin (11) and the shower (10), for which it is also connected to the entrance distribution duct (14) that provides clean water from the tank of clean water (6).

In other certain embodiments the water heater (19), for example, is an electrically operated instant water heater which only uses energy upon the taps' demand.

In still other embodiments the air conditioning compressor (18) is directly installed in the bulkhead (3), more concretely, on the wall of the body (2) attached on the bulkhead (3), so that the water resulting from the cooling condensation that it generates when it is operating is channeled towards the cistern of the WC (9), with the objective of reusing the water and preventing it from dripping outwardly from the cabin (1) where it can fall on the land or on other cabins (1) located below.

The air-conditioning compressor (18), preferably, is a small size and low consumption equipment, because the inner sizes of the body (2) that constitutes the useful space of the cabin (1) are small, in some embodiments around 20 *m*2.

In some embodiments the opposite bulkhead, in this case the left bulkhead (3') incorporates a current inverter (20) or regulator connected to one or more solar panels (21) installed on the body (2) of the cabin, and to one or more storage batteries (22) to supply electric energy to the different apparatuses of the cabin, including the electric apparatuses installed in the right bulkhead (4), and one or more sockets that the user can use.

In other embodiments the right bulkhead (3) with the systems of sanitary water supply just as the left bulkhead (3') with the systems of electric energy supply, could be also provided with connection to the water supply network (26) and electric energy supply network, respectively, as an alternative option if it is wished so for comfort or other circumstances.

It is appreciated that behind both bulkheads (3, 3') the body (2) of the cabin (1) possesses, as it was already said, respective side covers (23) that define the outer limit of the compartments (4, 4') in which are incorporated the functional auxiliary elements, the covers (23), preferably, are smooth and round shaped to protect the elements.

In some inventive embodiments the covers (23) shall be provided with ventilation grids and/or air openings for cooling the elements, even, when required, with some fan (elements not represented) to avoid electric components overheating.

In other embodiments the bulkheads (3, 3'), that, as it was said constitute very strong structural parts of the cabin (1) incorporate anchorages (24) for coupling stacked cabins (1), being in addition to those which support the weight of the upper units.

In still other embodiments the cabin has sizes, around 2.35×7 meters of base and a height ranging from 2, 7 and 3 meters, measurements that make it suitable to be carried in ordinary carriage means.

The nature of this invention being sufficiently disclosed, as well as the manner of implementing it, it is not considered necessary to extend any longer its explanation in order that any person skilled in the art understands its extent and the advantages resulting from it, and it is stated that, within its essence, it can be implemented in other embodiments that differ in detail of those mentioned herein for example purposes, and to which shall also apply the protection sought provided that its main principle is not altered, changed or modified.

The invention claimed is:

1. A carriable and modular cabin formed out of a body (2) having a rectangular parallelepipedal configuration, with a right side compartment (4), a left side compartment (4'), a floor, and a ceiling made of composite thermally insulated material, creating a diaphanous space in which different distributions, and different design can be made, as for several doors, windows or glazing (5), is characterized in that it comprises, at its side ends, the two compartments (4, 4') couplable to the cabin, one with auxiliary sanitary water supply elements and the other with auxiliary electric energy supply elements, each compartment with a bulkhead (3, 3'), the two compartments being protected behind openable respective covers (23) that define an external limit of the compartments (4, 4') and give respective access to the auxiliary sanitary water supply elements and the auxiliary electric energy supply elements allowing at least one of the replacement thereof or maintenance tasks thereon as modular elements.

2. The carriable and modular cabin, according to claim 1, characterized in that the bulkheads (3,3') are made of a material adapted to support a weight of a structure of the cabin and other cabins (1) that can be stacked on it.

3. The carriable and modular cabin, according to claim 1, further comprising two tanks of water under the floor of the rectangular body (2) of the cabin (1), of one of said two tanks of water adapted to contain clean water (6) and the other of said two tanks adapted to contain waste water (7), said two tanks of water virtually occupying the full extent of said floor and in communication with the side compartment (4) in which the auxiliary elements of sanitary water supply are built-in.

4. The carriable and modular cabin, according to claim 3, characterized in that the tank of clean water (6) possesses a submerged pump (8) to supply a shower (10), a WC (9), and a washbasin (11), the tank (6) possessing a water entrance (12) through one of the sides of the cabin (1) and a water exit (13) through the other of the sides of the cabin (1).

5. The carriable and modular cabin, according to claim 3, characterized in that the tank of waste water (7), arranged in parallel to the tank of clean water (6) under the body (2) of the cabin (1), is adapted to receive all the water coming from an unloading cistern of a WC (9) and of the rest of said auxiliary sanitary water supply elements.

6. The carriable and modular cabin, according to claim 5, characterized in that the tank of waste water (7) also possesses a submerged pump (8) with connection to a water exit (13).

7. The carriable and modular cabin, according to claim 4, characterized in that both the clean water tank (6) and the waste water tank (7) have in their interior a small converging unevenness towards their center, to facilitate gravitational pull of the water contained therein down to the submerged pumps (8), placed at the center of each tank.

8. The carriable and modular cabin, according to claim 4, characterized in that the auxiliary sanitary water supply elements are located on an inner wall of the body (2) attached to the bulkhead.

9. The carriable and modular cabin, according to claim 8, characterized in that in said bulkhead (3) a supply of clean water comes, from the tank of clean water (6), through an entrance distribution duct (14) and is channeled towards the auxiliary sanitary water supply elements, with a circuit of exploitation of the clean water (15) that connects the washbasin (11), the WC (9), and the shower (10), where a backpack cistern (16) is adapted to generate the pressure necessary to push waste towards a crushing device that sends crushed waste to the tank of waste water (7).

10. The carriable and modular cabin, according to claim 9, characterized in that in said bulkhead (3) the clean water comes, from the tank of clean water (6), through an entrance distribution duct (14) and is directly channeled to the auxiliary sanitary water supply elements coupling an exit of a drain of said WC (9) to the crushing device that sends crushed waste to the tank of waste water (7).

11. The carriable and modular cabin, according to claim 1, characterized in that the bulkhead (3) of the auxiliary sanitary water supply elements comprises an air conditioning compressor (18).

12. The carriable and modular cabin, according to claim 11, characterized in that the air-conditioning compressor (18) is installed on a wall of the body (2) attached to the bulkhead (3), and adapted such that water resulting from cooling condensation that it generates when it is operating is channeled toward a WC cistern (9).

13. The carriable and modular cabin, according to claim 1, further comprising a water heater (19) installed within its central body (2) and adapted to supply hot water to a washbasin (11) and a shower (10), and connected to an entrance distribution duct (14) that provides clean water from a tank of clean water (6).

14. The carriable and modular cabin, according to claim 1, characterized in that the bulkhead opposite to the auxiliary sanitary water supply elements incorporates a current inverter (20) or regulator connected, to one or more solar panels (21) installed on the body (2) of the cabin, and to one or more storage batteries (22), to supply electric energy to the different elemetns of the cabin.

15. The carriable and modular cabin, according to claim 1, characterized in that the bulkhead (3) with the auxiliary sanitary water supply elements and the bulkhead (3') with the auxiliary electric energy supply elements, are also provided with connection to a network of water and energy supply, respectively.

16. The carriable and modular cabin, according to claim 1, characterized in that the covers (23) have a smooth and round shape and are provided with one or more of ventilation grids, air openings, or a fan.

17. The carriable and modular cabin, according to claim 1, characterized in that the bulkheads (3, 3') incorporate anchorages (24) for coupling stacked cabins (1).

18. The carriable and modular cabin, according to claim 1, characterized in that the cabin has sizes of around 2.35×7 meters of base and a height ranging from 2.7 to 3 meters.

* * * * *